US008584264B2

(12) United States Patent
Arai

(10) Patent No.: US 8,584,264 B2
(45) Date of Patent: Nov. 19, 2013

(54) CHEEK PAD FOR HELMET AND HELMET

(76) Inventor: Michio Arai, Saitamaken (JP)

( * ) Notice: Subject to any disclaimer, the term of this patent is extended or adjusted under 35 U.S.C. 154(b) by 137 days.

(21) Appl. No.: 12/923,638

(22) Filed: Sep. 30, 2010

(65) Prior Publication Data

US 2012/0017357 A1 Jan. 26, 2012

(30) Foreign Application Priority Data

Jul. 23, 2010 (JP) ..... 2010-166347

(51) Int. Cl.
*A42B 3/00* (2006.01)

(52) U.S. Cl.
USPC ..... 2/414; 2/424

(58) Field of Classification Search
USPC ..... 2/414, 424, 410, 411, 421, 425, 9
See application file for complete search history.

(56) References Cited

U.S. PATENT DOCUMENTS 3,843,970 A * 10/1974 Marietta et al. ..... 2/415
4,916,759 A * 4/1990 Arai ..... 2/414
5,093,937 A * 3/1992 Kamata ..... 2/424
5,165,117 A * 11/1992 Kamata ..... 2/424
6,138,284 A 10/2000 Arai
6,185,753 B1 2/2001 Arai
6,370,699 B1 * 4/2002 Halstead et al. ..... 2/414
2001/0039674 A1 * 11/2001 Shida ..... 2/414
2007/0250991 A1 * 11/2007 Pierce ..... 2/414

FOREIGN PATENT DOCUMENTS

DE 202004005188 7/2004
JP H08199417 8/1996

OTHER PUBLICATIONS

English Abstract of JPH08199417.
English Absract of DE202004005188.

* cited by examiner

*Primary Examiner* — Khoa Huynh
*Assistant Examiner* — Brieanna Fuller
(74) *Attorney, Agent, or Firm* — Dykema Gossett PLLC

(57) ABSTRACT

A cheek pad for mounting on an inside of a helmet shell includes an attaching member and a cushion member, the attaching member including a base member mounted in contact with the shell and a form-maintaining member disposed at an inner lower section of the base member in a space provided with respect to the cushion member for simultaneously keeping a surface of the cushion member in a profile corresponding to the cheek and chin of a wearer when the helmet is worn by a wearer and, following displacement that causes the space to contract, is restored so as to return to an original location under normal circumstances, and kept there. Elastic members are positioned in the space between the base member and the form-maintaining member to help restore the space to an original configuration subsequent to contraction.

3 Claims, 11 Drawing Sheets

CHEEK PAD FOR HELMET AND HELMET

FIELD OF THE INVENTION

The present invention relates to a cheek pad for use in a full-face type helmet for cradling a wearer's cheeks during riding any of a variety of moving vehicles such as automobiles or motorcycles; watercraft such as motorboats; or other transportation means such as bicycles.

BACKGROUND OF THE INVENTION

Referring to FIGS. 13 and 14, there are known in the art full-face helmets equipped with cheek pads that have the function of cradling the cheeks of the wearer. These cheek pads include an attaching member 100 attachable to the inside of the helmet shell and a cushion member 101 attached to the attaching member 100. The elasticity of the cushion member 101 is related to the cheek/chin cradling function and the fitting comfort in full-face helmets of such description. The function of cradling the cheek and chin of a wearer is exhibited by having the elasticity of the cushion member utilized to achieve intimate contact of the cushion member against the cheek and chin of a wearer. With regard to fit, the elasticity of the cushion member is utilized so that the pressure at which the cushion member contacts the cheek and chin is released by the deformation of the cushion member in the thickness direction, whereby intimate contact is achieved without excessive pressure applied to the cheek and chin.

According to the present invention, there is provided a cheek pad for a helmet having an improved cradling function and fitting comfort, while allowing the helmet to be readily put on and removed. The invention also relates to a helmet that includes such a cheek pad.

SUMMARY OF THE INVENTION

The inventive helmet cheek pad includes an attaching member disposed facing in a thickness direction a shell constituting the outermost layer of a helmet, and a cushion member disposed to the inside of the attaching member, the cheek pad being disposed at inner left and right portions of the shell so as to cradle a wearer from the cheek to the chin portion, wherein the attaching member includes a base member mounted in contact with the shell, and a form-maintaining member disposed at an inner lower section of the base member with a space left with respect to the base member; and the form-maintaining member, while simultaneously keeping a surface corresponding to the cushion member in a profile following the cheek to the chin portion of the wearer, causes the space to contract as a result of being outwardly displaced in the thickness direction in response to greater-than-normal force applied when the helmet is put on and taken off; and, following the displacement that causes the space to contract, is restored so as to return to an original location under normal circumstances and kept at the original location.

DESCRIPTION OF THE PREFERRED EMBODIMENTS

Figure 1:
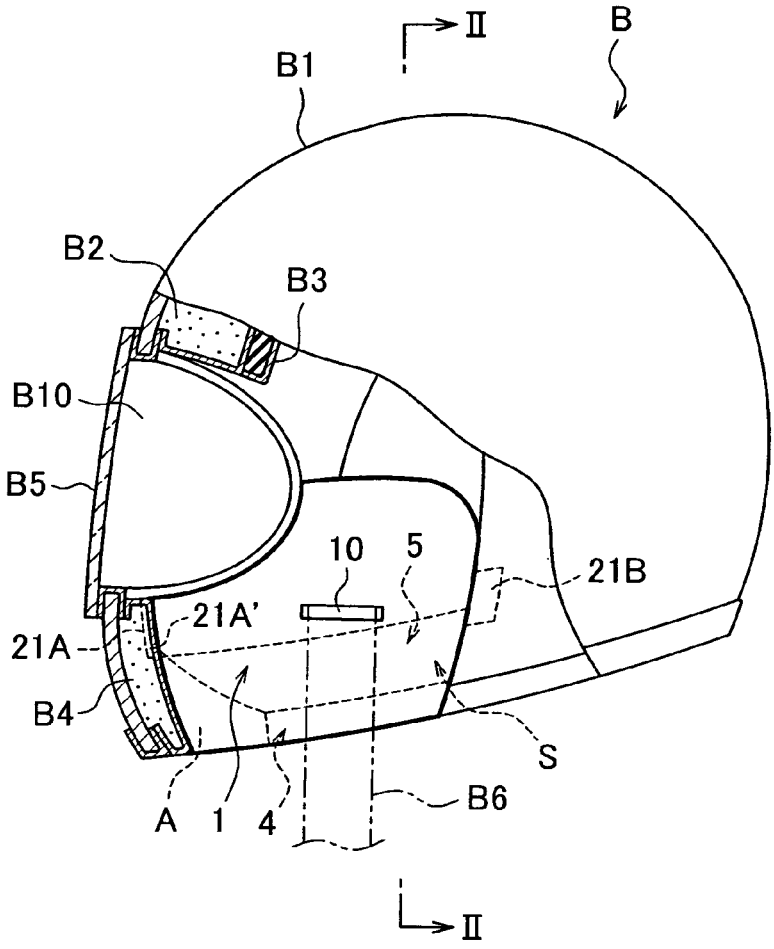
FIG. 1 is a side view of a cheek pad according to a first embodiment of the invention, shown installed in a helmet.

Embodiments of the helmet cheek pad ("cheek pad" hereinafter) according to the present invention are described below based on the accompanying drawings. FIG. 1 depicts a cheek pad 1 according to a first embodiment of the invention, installed in a full-face helmet B.

The full-face helmet ("helmet" hereinafter) B in the present embodiment is molded from a fiber-reinforced resin material to a full-face shape, and the inside of the shell B1 constituting the outermost layer of the helmet B is provided with an impact-absorbing liner B2 of foamed polystyrene or a comparable material with a shock-absorbing function molded to a shape conforming to the head-facing side of the shell B1; a mount body B3 mounted to the inside face of the impact-absorbing liner B2; a chin guard B4 molded to a shape conforming to a zone extending from the chin portion in the lower part of a front opening B10 of the shell B1 towards areas to the side of the left and right cheeks; a shield B5 pivotably disposed on the shell B1 so as to open and close the opening B10; and cheek pads 1 with contours adapted to the left and right cheek areas of the shell B1 (only the right pad is shown in the drawing). Also provided are a pair of left and right chin straps B6 (the right side strap is shown in the drawing) pivoted at one end to the left and right cheek areas of the shell Bl, the other end of the chin strap B6 being passed through a chin strap through-hole 10 formed in the cheek pad 1, and being positioned inside the helmet B.

Figure 2:
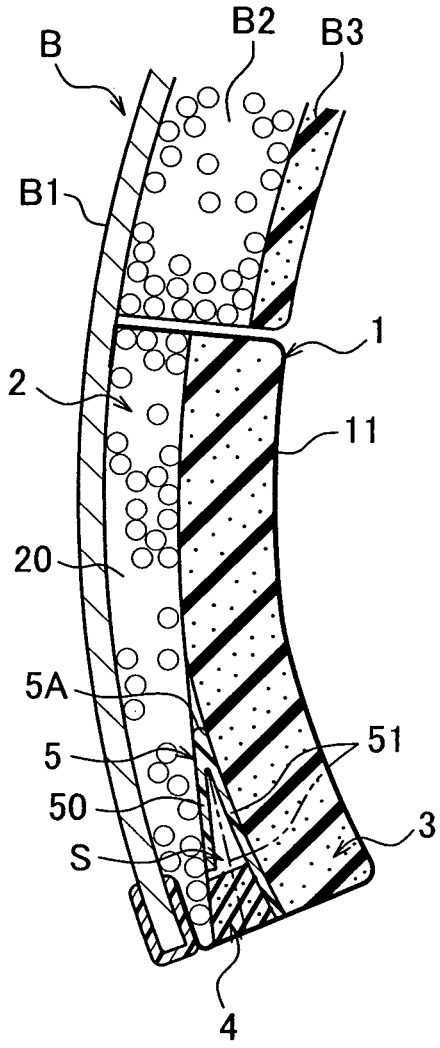
FIG. 2 is a sectional view taken along (II)-(II) in FIG. 1, depicting the cheek pad in an enlarged fragmentary view.
Figure 3:
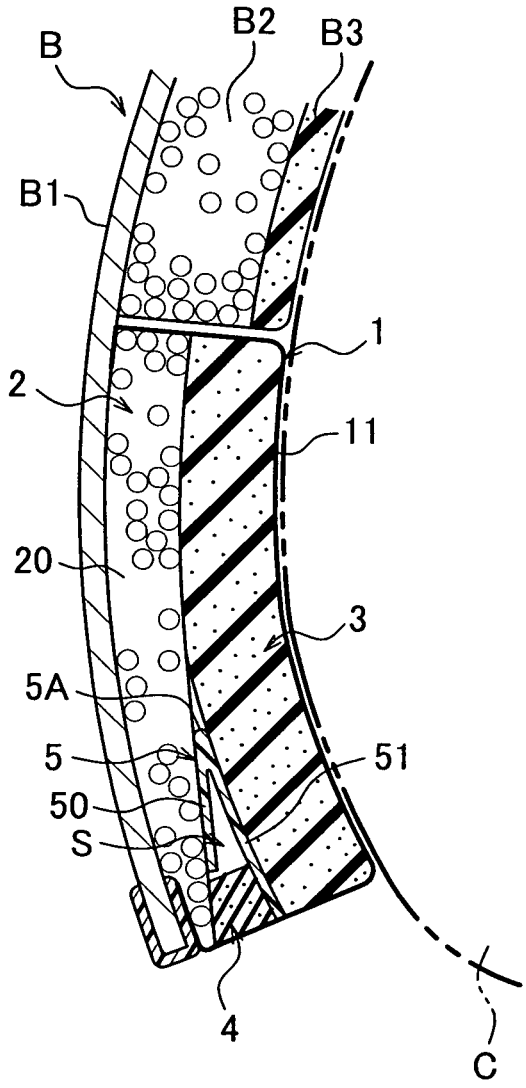
FIG. 3 shows a fragmentary view of the cheek pad in FIG. 2, depicted when the helmet shown in FIG. 1 is worn.

FIGS. 2 to 5 are configuration diagrams of the cheek pad 1 depicted in FIG. 1. FIGS. 2 and 3 depict the cheek pad 1 installed in the helmet B, while FIG. 4 and FIG. 5 omit the exterior cover 11 shown in FIG. 2 and the hook members 21A, 21B shown in FIG. 1.

As shown in FIG. 2, the pad 1 includes an attaching member 2, a cushion member 3, and an elastic member 4 securely fixed in a layered configuration, with the attaching member 2, a cushion member 3, and the elastic member 4 being enclosed in an exterior cover 11.

The attaching member 2 includes a base member 20 of prescribed shape made from a material comparable to the impact-absorbing liner B2; hook members 21A, 21B (see FIG. 1) situated in two locations, front and back, for mounting the cheek pad 1 onto the shell B1; and a form-maintaining member 5 adapted to adjust the side of the cushion member 3 facing a wearer C to a profile following along the cheek to chin portion of the wearer C, and to maintain this profile.

The base member 20 has formed therein a through-hole 10A (see FIG. 4) constituting a portion of the chin strap through-hole 10.

As shown in FIG. 1, the hook members 21A, 21B are protruding members disposed protruding frontward and rearward relative to the base member 20; the rear hook member 21B fitting between the impact-absorbing liner B2 and the shell B1, and the front hook member 21A mating with a hook member 21A' provided to the chin guard B4, whereby the cheek pad 1 is attached to the shell B1.

The cushion member 3 is formed to a prescribed profile from a pliable material made of urethane, a spongy substance, or foamed polyethylene, these materials being elastic enough to make intimate contact with the cheek to chin portion of the wearer due to repulsion force resulting from recovery from deformation.

Figure 4:
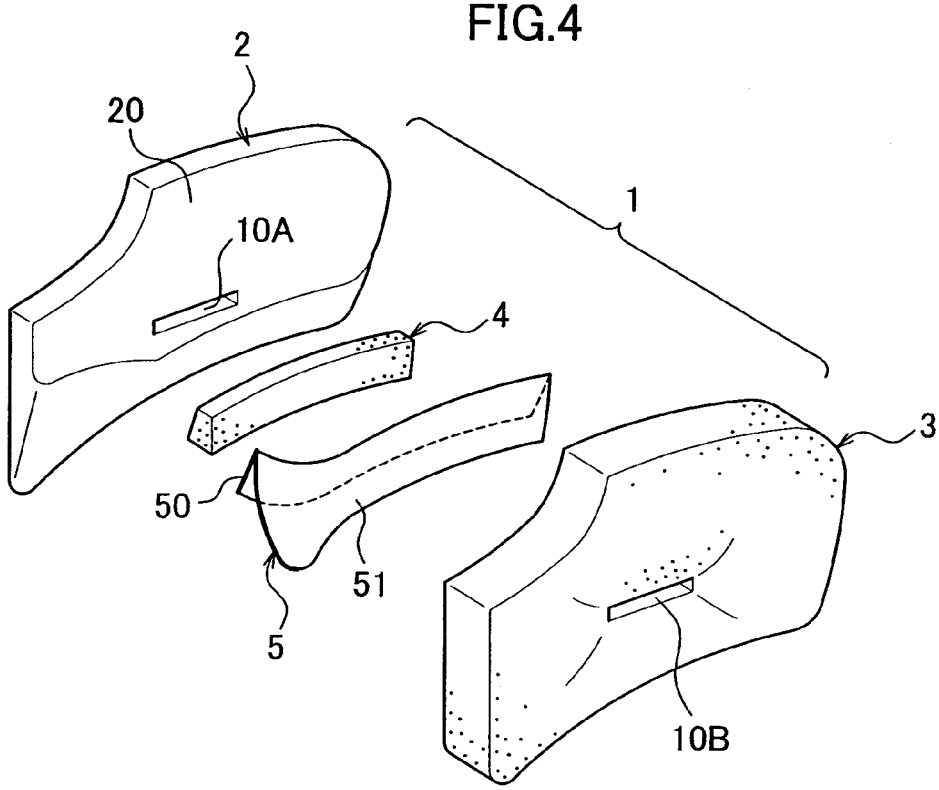
FIG. 4 is an exploded perspective view of the cheek pad according to the first embodiment of the invention.
Figure 5:
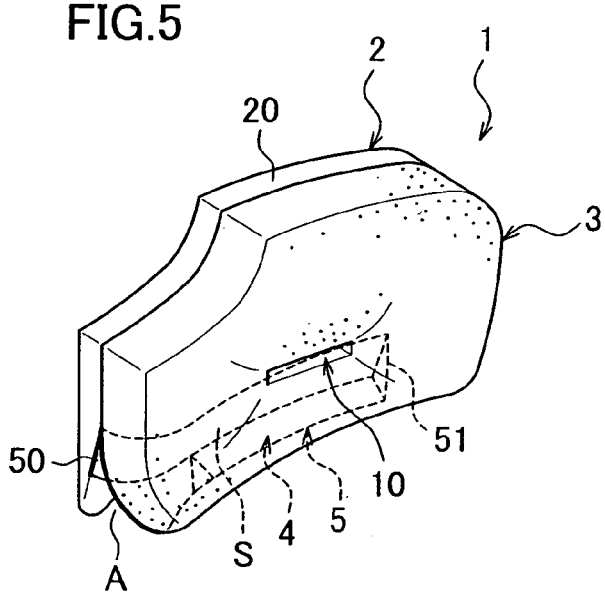
FIG. 5 is a perspective view of the cheek pad according to the first embodiment of the invention.

As shown in FIGS. 4 and 5, the cushion member 3 has formed therein a through-hole 10B constituting a portion of the chin strap through-hole 10, and is configured such that when the attaching member 2 and the cushion member 3 are placed together, the through-holes 10A, 10B align to form the chin strap through-hole 10.

As shown in FIG. 2, a space S capable of being compressed outwardly in the thickness direction is provided for the purpose of causing the form-maintaining member 5 to be displaced outwardly in the thickness direction (the collapsing direction). The space S is designed to undergo compression outwardly in the thickness direction in response to displacement of the form-maintaining member 5 associated with deformation of the cushion member 3 outwardly in the thickness direction. Compression of the space S outwardly in the thickness direction allows the form-maintaining member 5 to be displaced so as to move closer towards the base member 20.

When the helmet B is put on or taken off, the chin strap B6 shown in FIG. 1 is pulled outwardly causing the cheek pads 1 to be subjected to force in excess of the normal force when the helmet B is worn and tending to spread the helmet B apart in the horizontal direction. Once deformation of the cushion member 3 outwardly in the thickness direction reaches a critical limit, the form-maintaining member 5 begins to deform and the space S becomes compressed outwardly in the thickness direction, whereby the cushion member 3 is displaced so as to get closer to the base member 20. Specifically, when the helmet B is put on or taken off, the lower opening B11 of the helmet B is capable of readily expanding, making it easy to put on and take off the helmet B.

The elastic member 4 is formed from a pliable material made of urethane, a spongy substance, or foamed polyethylene that has greater elasticity than the cushion member 3, and is elastic enough to generate repulsion force resulting from recovery from deformation, without injuring the wearer C.

As shown in FIG. 4 and FIG. 5, the elastic member 4 has a thickness approximately equal to the thickness of the base member 20, a vertical width somewhat greater than its thickness, and a length that is the same as the length of the bottom edge of the base member 20 excluding of the guiding path A. The elastic member 4 is interposed in the space S along the entire bottom edge of the base member 20 exclusive of the guiding path A, so that the bottom edge of the elastic member 4 is flush with the bottom edge of the base member 20.

The base member 20 and the cushion member 3 are bonded together except in the portion of the interposed space S, whereby the base member 20, the form-maintaining member 5, the cushion member 3, and the elastic member 4 are unified.

The form-maintaining member 5 is formed with an inverted V formation (or an inverted U formation), as shown in the drawings, from a synthetic resin or other elastic material that is soft enough for flexural deformation. A first edge face thereof is .anchored to the base member 20 inside the space S, and the other edge face is anchored to the cushion member 3 inside the space S.

The first edge face corresponds in shape to the face at the upper side of the base member 20 within the space S, and constitutes a fixing part 50 for anchoring to the surface at the upper side of the base member 20. The other edge surface corresponds in shape to the section of the cushion member 3 that faces the space S; and, as shown in FIG. 3, constitutes a holding part 51 having a face adapted to maintain a profile following along the cheek to chin portion of the wearer C (see FIG. 7), in opposition to force acting outwardly in the thickness direction of the cushion member 3.

The corner 5A having an inverted V formation experiences a contraction in the degree of its internal angle as the space S compresses, and is also acted on by a recovery force (repulsion force) arising during recovery from this contraction. Specifically, when the form-maintaining member 5 having undergone displacement due to contraction of the space S returns to its original state due to this recovery force, the form-maintaining member 5 holds the cushion member 3 in a profile following the cheek to chin portion of the wearer C so as to support the cheek to chin portion of the wearer C.

In cases where the form-maintaining member 5 has an inverted V formation, the direction in which the corner 5A recovers from contraction is a direction such that, when the space S has contracted along an arc centered on the corner 5A, the space S expands against the contraction. Specifically, recovery force arising when the corner 5A recovers from contraction acts in a direction along an arc centered on this corner 5A, which is also a direction supporting the cheek to chin portion of the wearer C from below.

Consequently, the form-maintaining member 5 causes the cushion member 3 to be held in a profile following the cheek to chin portion of the wearer C so that the cheek to chin portion of the wearer C is supported from below. As a result, the cradling function of the helmet B is enhanced, and the helmet B is given improved fitting comfort.

Any construction may be used by which the form-maintaining member 5 is able to restore and maintain the cushion member 3 in a profile following the cheek to chin portion of the wearer C against force acting outwardly in the thickness direction of the cushion member 3 and to support the cheek to chin portion of the wearer C, the construction in an inverted V formation described here by example not being provided by way of limitation.

By having the elastic member 4 anchored between the holding part 51 and the base member 20 so that the elastic member 4 is so interposed within the space S, the elastic member 4 undergoes elastic deformation in concert with displacement of the holding part 51 due to contraction of the space S when the helmet B is put on or taken off, and recovery force (repulsion force) arising during recovery from this elastic deformation acts on the holding part 51. Specifically, the recovery force of the elastic member 4 translates to a force pushing the holding part 51 towards the cushion member 3, and this force combines with the recovery force of the form-maintaining member 5 displaced in association with contraction of the space S to more firmly keep the cushion member 3 to a profile following the cheek to chin portion of the wearer C.

Having the cushion member 3 kept to a profile following the cheek to chin portion of the wearer C through the agency of the elastic member 4 and the form-maintaining member 5 thus enables the cushion member 3 to be positioned in firm contact against the cheek to chin portion of the wearer. Accordingly, the cradling function of the helmet B may be enhanced, and the helmet B may be able to provide improved fitting comfort.

By changing the rigidity of the elastic member 4, it is possible to adjust the fitting comfort without having to replace the cushion members 3 or the form-maintaining members 5.

Figure 6:
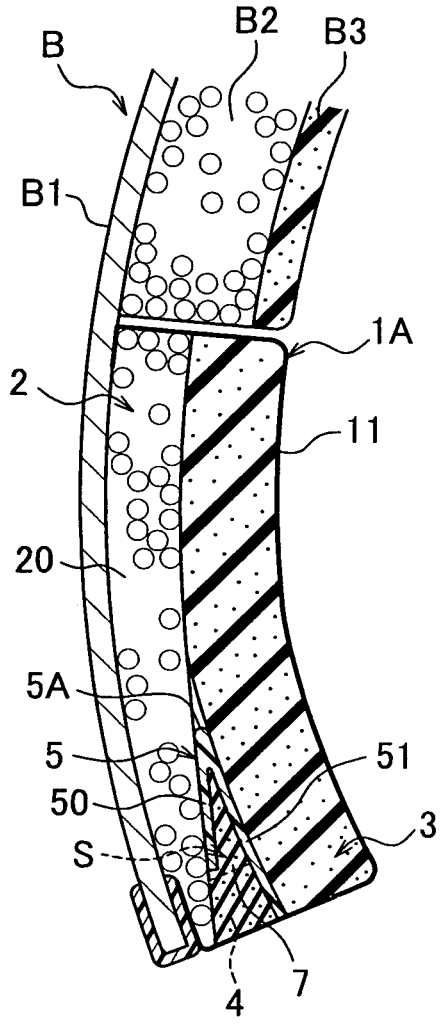
FIG. 6 is a sectional view depicting a cheek pad according to a second embodiment of the invention.

FIG. 6 depicts a cheek pad 1A according to a second embodiment of the invention. Portions in the second embodiment that are the same as those in the preceding first embodiment are assigned the same drawing symbols, without attendant description.

In the cheek pad 1A of the present embodiment, the space S is filled with a stuffing 7 having lower elasticity than the cushion member 3 so as to not hinder the form-maintaining member 5 from deforming. The stuffing 7 fills the space S so that there will be no unevenness due to the space S between the base member 20 and the cushion member 3. However, some unevenness is acceptable.

According to the aforedescribed cheek pad 1A filled with stuffing 7, wrinkles in the exterior cover 11 resulting from unevenness may be prevented from forming when the exterior cover 11 is wrapped around the base member 20 and the cushion member 3, and a cheek pad 1A of attractive appearance can be provided. Moreover, the fact that the stuffing 7 is designed not to hamper deformation of the form-maintaining member 5 enables the space S to contract outwardly, and properly, in the thickness direction; and the cushion member 3 to be displaced outwardly in the thickness direction as in the first embodiment described above.

Examples of materials that allow the stuffing 7 to have lower elasticity than the cushion member 3 include those made of urethane, spongy substances, foamed polyethylene, and cotton of lower density than the cushion member 3. However, materials having lower elasticity than the cushion member 3 are not provided by way of limitation to the stuffing 7, as long as the material does not hamper deformation of the form-maintaining member 5.

Figure 7:
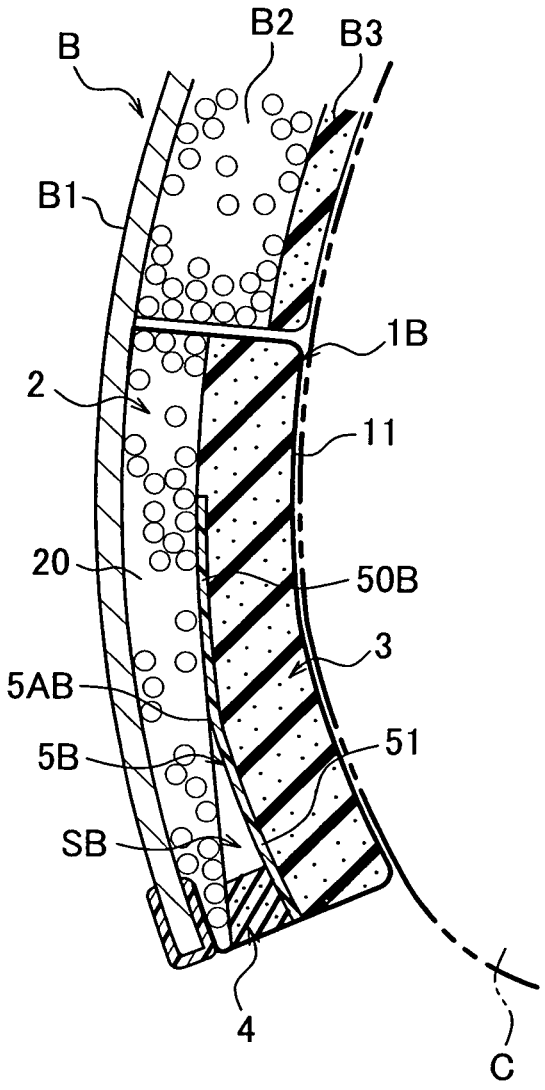
FIG. 7 is a sectional view depicting a cheek pad according to a third embodiment of the invention.
Figure 8:
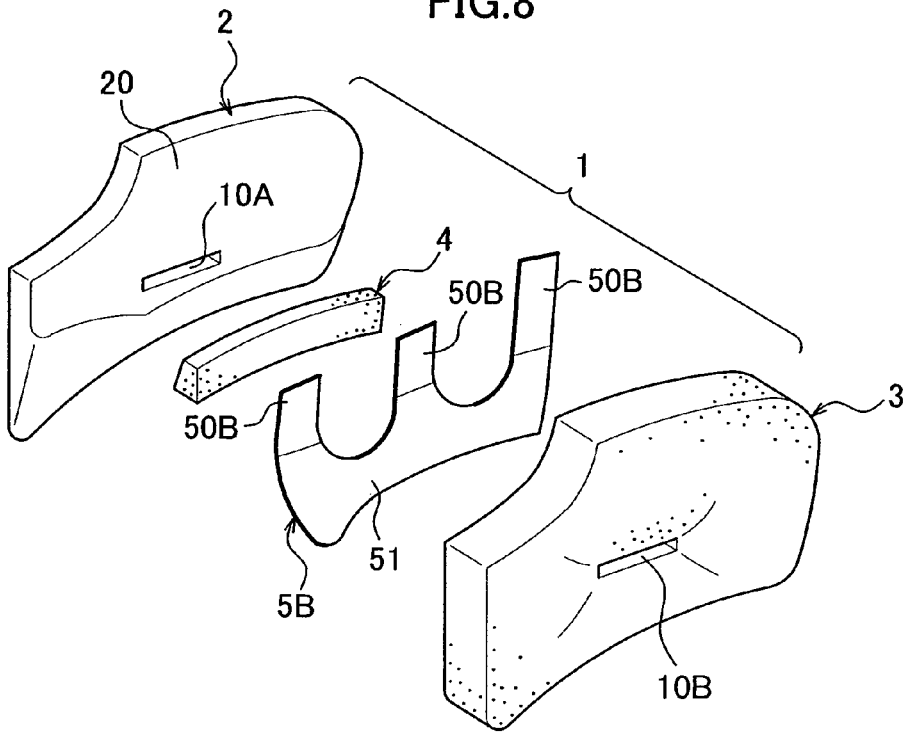
FIG. 8 is an exploded perspective view depicting the cheek pad according to the third embodiment of the invention.

FIGS. 7 and 8 depict a cheek pad 1B according to a third embodiment of the invention. The cheek pad 1B of the third embodiment involves a form-maintaining member 5B different in form from the form-maintaining member 5 in the first and second embodiments. Portions in the third embodiment that are the same as those in the first embodiment described earlier are assigned the same drawing symbols, without attendant description. The exterior cover 11 and the hook members 21A, 21 have been omitted in FIG. 8.

The form-maintaining member 5B of the present embodiment takes a form in which a corner 5AB has a more obtuse angle than does the form-maintaining member 5 of the first embodiment, and a fixing part 50B extends upward from a holding part 51 of similar construction to the holding part 51 of the first embodiment. The fixing part 50B is anchored to the base member 20 above a space SB and is positioned so as to be disposed between the base member 20 and the cushion member 3. The fixing part 50B and the holding part 51 connect at an angle such that at the upper edge section of the space SB, the holding part 51 inhibits deformation of the cushion member 3 against a force acting in the thickness direction of the cushion member 3, and the cushion member 3 is restored and kept to a profile following the cheek to chin portion of the wearer C.

As shown in FIG. 8, the fixing part 50B is formed with a plurality of segments (three in FIG. 8) spaced apart from one another at equal intervals in the lengthwise direction of the holding part 51. When the fixing part 50B is anchored to the base portion 20, the gaps between these segments become smaller, thereby imparting to the holding part 51 a three-dimensional shape and angle that serve to inhibit deformation of the cushion member 3 against a force acting in the thickness direction of the cushion member 3, as well as to enable the cushion member 3 to be restored to and kept in a profile following the cheek to chin portion of the wearer C.

The cheek pad 1B provided with the form-maintaining member 5B can be expected to produce an action and effect comparable to that of the cheek pad 1 of the first embodiment. The cheek pad 1B is attached to the base member 20 in a configuration in which the fixing part 50B is disposed between the base member 20 and the cushion member 3, affording a more secure arrangement for attaching the form-maintaining member 5B to the base member 20.

Figure 9:
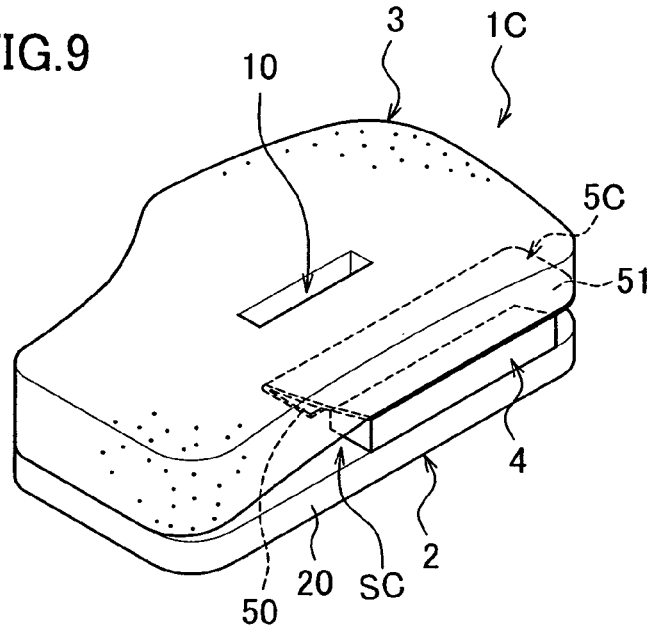
FIG. 9 is a perspective view depicting a cheek pad according to a fourth embodiment of the invention.

While the preceding embodiments have shown by way of example cheek pads furnished with a conventional cheek pad guiding path A, a cheek pad 1C not provided with a guiding path A may also be included according to a fourth embodiment of the invention, as depicted in FIG. 9. Portions that are the same as those in the preceding first embodiment are assigned the same symbols, without attendant description. The exterior cover 11 and the hook members 21A, 21 have been omitted in FIG. 9.

The cheek pad 1C of the present embodiment is furnished with a form-maintaining member 5C devoid of a portion corresponding to the guiding path A in the form-maintaining member 5 of the first embodiment. The cheek pad 1C is bonded to the cushion member 3 and the base member 20 in the zone corresponding to the guiding path A, so that a space SC is provided rearward of this bonded section.

According to this cheek pad 1C as well, the cushion member 3 is restored to and kept in a profile following the cheek to chin portion of the wearer C by the form-maintaining member 5C, and the cheek to chin portion of the wearer C can be supported from below. Therefore, the cradling function of the helmet B can be improved, and the helmet B can be capable of providing improved fitting comfort.

Figure 10:
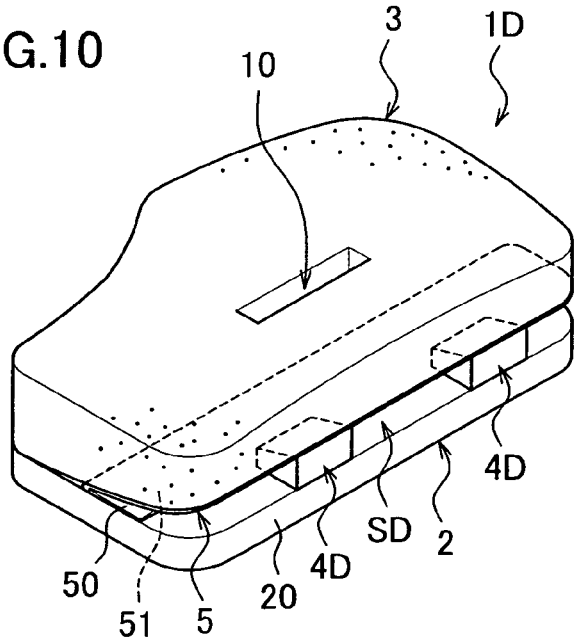
FIG. 10 is a perspective view depicting a cheek pad according to a fifth embodiment of the invention.

A cheek pad 1D according to a fifth embodiment of the invention depicted in FIG. 10 is provided with a plurality of elastic members (two are shown). The cheek pad 1D of the fifth embodiment has a configuration in which two short elastic members 4D, 4D are interposed spaced apart from one another. Portions that are the same as those in the preceding first embodiment are assigned the same symbols, without attendant description. While the present embodiment shows an example of a configuration in which two elastic members 4D are used, three or more elastic members 4D may be used. The exterior cover 11 and the hook members 21A, 21 have been omitted in FIG. 10.

According to a cheek pad 1D of such description, the magnitude of elasticity resisting contraction of a space SD may be adjusted according to the elasticity of the elastic members 4D, 4D, and, simultaneously, the space SD can be restored to and kept in the original state.

Figure 11:
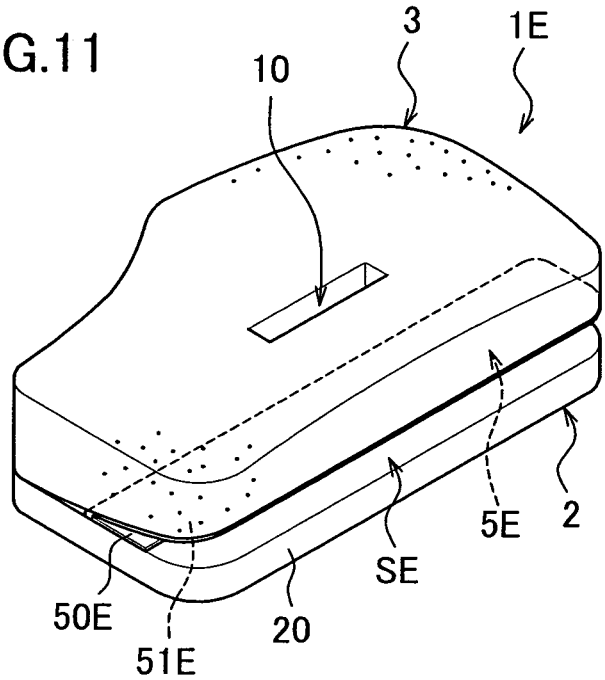
FIG. 11 is a perspective view depicting a cheek pad according to a sixth embodiment of the invention.

A cheek pad 1E according to a sixth embodiment of the invention has no interposed elastic member, as depicted in FIG. 11. According to the cheek pad 1E of the sixth embodiment, the cushion member 3 is restored to and kept in a profile following the cheek to chin portion of the wearer C by a form-maintaining member 5E, and the cheek to chin portion of the wearer C can be supported from below. Therefore, the cradling function of the helmet B can be enhanced, and the helmet B can provide improved fitting comfort. The exterior cover 11 and the hook members 21A, 21 have been omitted in FIG. 11.

Figure 12:
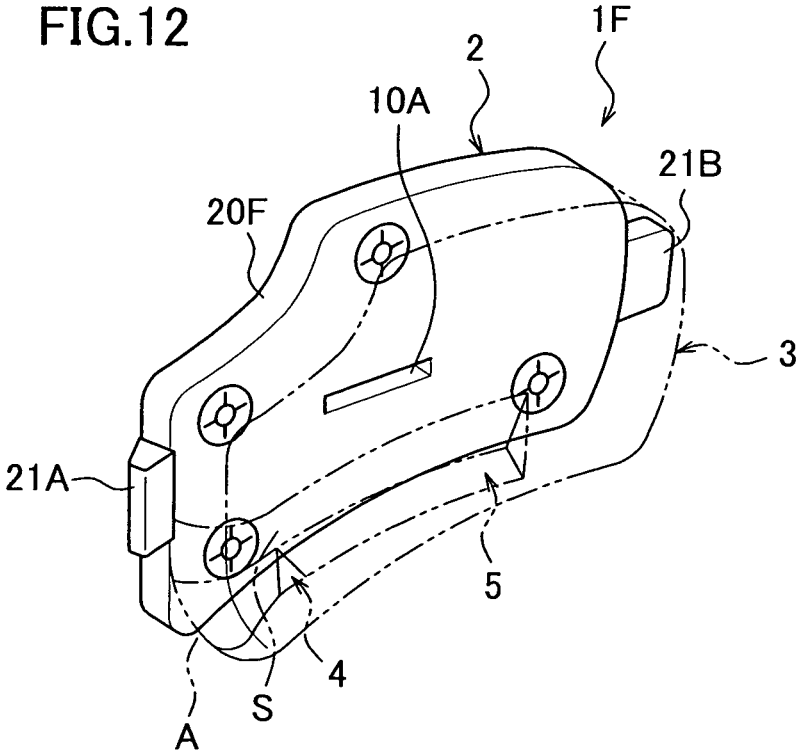
FIG. 12 is a perspective view depicting a cheek pad according to a seventh embodiment of the invention.
Figure 13:
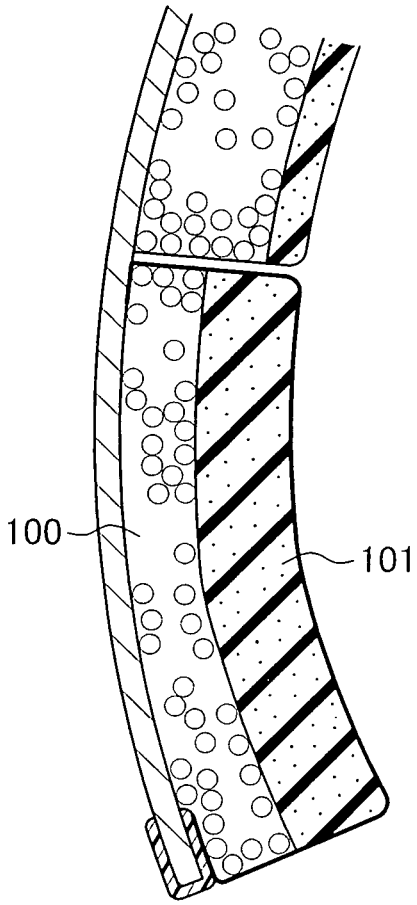
FIG.13 (PRIOR ART)
FIG. 13 is a sectional view of a cheek pad having a conventional structure.
Figure 14:
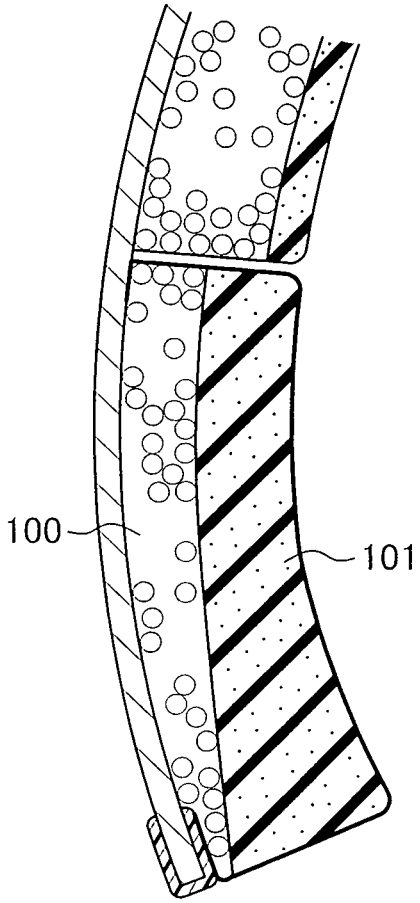
FIG.14 (PRIOR ART)
FIG. 14 is a sectional view of a cheek pad having a conventional structure.

A cheek pad 1F according to a seventh embodiment of the invention is furnished with a base member 20F fashioned in the form of a plate and made of synthetic resin, as depicted in FIG. 12. The cheek pad 1F having the base member 20F can be expected to produce an action and effect comparable to that of the cheek pad 1 of the first embodiment. Portions that are the same as those in the preceding first embodiment are assigned the same symbols, without attendant description.

While the present embodiment shows an example of a cheek pad 1 designed with a shape for use in a full-face helmet, the term "helmet" as used in the present invention also refers to helmets that are not full-face helmets. Specifically, configuring the cheek pad 1 using a profile encountered in open face helmets.

The form-maintaining member according to the present invention is preferably an elastic body having a configuration whereby the space between the base member and the cushion member is restored to and kept in the original state due to the elasticity of the form-maintaining member, and the surface corresponding to the cushion member constitutes a profile following along the cheek to chin portion of the wearer. Preferably, the form-maintaining member is a plate member having low elasticity, and is adapted so that the surface corresponding to the cushion member is imparted with a profile following the cheek to chin portion of the wearer. More preferably, the form-maintaining member is a plate member having low elasticity, and a plurality of fixing parts are anchored to the base member. By anchoring the fixing parts to the base member, the surface corresponding to the cushion member is imparted with a profile following the cheek to chin portion of the wearer.

Preferably, there is also provided between the base member and the form-maintaining member an elastic member for adjusting the magnitude of elasticity resisting contraction of the space while simultaneously restoring the space to the original state.

The space may be filled with a stuffing that does not hinder deformation of the form-maintaining member.

The base member according to the present invention may, for example, be a cushioning member with cushioning characteristics.

It is to be understood that the invention is not limited to the embodiments presented herein and given by way of example, and may also be implemented according to aspects that do not depart from the scope as recited in the claims.

We claim:

1. A cheek pad for use in a helmet, said cheek pad comprising:

an outer base member for attachment to an inside of a helmet shell, an inner cushion member for contacting a cheek and chin of a helmet wearer, said inner cushion member being directly connected at an upper end to said outer base member and at a lower end configured to conform to the cheek and chin of the helmet wearer and to define a separating space with the outer base member, an inverted V-shaped form-maintaining member in said separating space, said inverted V-shaped form-maintaining member including a holding part which contacts a surface of said inner cushion member so as to resist changes in configuration of the lower end of said inner cushion member during use, and a fixing part which is connected to the outer base member and is separated from the holding part so that a portion of said separating space lies therebetween, and at least one elastic member separate from and beneath said inverted V-shaped form-maintaining member which is positioned in said separating space between the outer base member and the holding part of said inverted V-shaped form-maintaining member for assisting in resisting changes in configuration of the lower end of said inner cushion member.

2. The cheek pad according to claim 1, including a plurality of said elastic members in said separating space.

3. A combination of a helmet with a shell and a cheek pad for mounting in said shell, said cheek pad comprising:

an outer base member for attachment to an inside of said helmet shell, an inner cushion member for contacting a cheek and chin of a helmet wearer, said inner cushion member being directly connected at an upper end to said outer base member and at a lower end configured to conform to the cheek and chin of the helmet wearer and to define a separating space with the outer base member, an inverted V-shaped form-maintaining member in said separating space, said inverted V-shaped form-maintaining member including a holding part which contacts a surface of said inner cushion member so as to resist changes in configuration of the lower end of said inner cushion member during use, and a fixing part which is connected to the outer base member and is separated from the holding part so that a portion of said separating space lies therebetween, and at least one elastic member separate from and beneath said inverted V-shaped form-maintaining member which is positioned in said separating space between the outer base member and the holding part of said inverted V-shaped form-maintaining member for assisting in resisting changes in configuration of the lower end of said inner cushion member.

* * * * *